US010186784B2

(12) United States Patent
Murch et al.

(10) Patent No.: US 10,186,784 B2
(45) Date of Patent: Jan. 22, 2019

(54) ANTENNA APPARATUS

(71) Applicant: Huawei Technologies Co., Ltd., Shenzhen (CN)

(72) Inventors: Ross Murch, Hong Kong (HK); Saber Soltani, Hong Kong (HK); Rongdao Yu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/270,935

(22) Filed: Sep. 20, 2016

(65) Prior Publication Data

US 2017/0012362 A1 Jan. 12, 2017

Related U.S. Application Data

(63) Continuation of application No. PCT/CN2014/073820, filed on Mar. 21, 2014.

(51) Int. Cl.
*H01Q 13/16* (2006.01)
*H01Q 21/06* (2006.01)
(Continued)

(52) U.S. Cl.
CPC ..... *H01Q 13/106* (2013.01); *H01Q 1/241* (2013.01); *H01Q 13/16* (2013.01); *H01Q 21/064* (2013.01)

(58) Field of Classification Search
CPC ..... H01Q 13/08; H01Q 13/10; H01Q 13/16; H01Q 1/38; H01Q 5/49; H01Q 5/378; H01Q 21/061; H01Q 13/106; H01Q 13/18
See application file for complete search history.

(56) References Cited

U.S. PATENT DOCUMENTS 3,832,716 A 8/1974 Plunk et al.
4,792,809 A * 12/1988 Gilbert ..... H01Q 13/106 343/770
(Continued)

FOREIGN PATENT DOCUMENTS

CN 1636299 A 7/2005
CN 101533939 A 9/2009
(Continued)

OTHER PUBLICATIONS

Morioka et al. "Slot antenna with parasitic element for dual band operation" IEEE Elect. Letters vol. 33, Issue 25 p. 2093-2094; Dec. 4, 1997.*
(Continued)

*Primary Examiner* — Dameon E Levi
*Assistant Examiner* — Ricardo Magallanes
(74) *Attorney, Agent, or Firm* — Leydig, Voit & Mayer, Ltd.

(57) ABSTRACT

Embodiments of the present invention provide an antenna apparatus, including multiple antenna elements, where the antenna element includes a dielectric plate, one two-antenna array element, and one parasitic element; the two-antenna array element is located at the front of the dielectric plate; the parasitic element is located on the back of the dielectric plate, and a location of the two-antenna array element falls within an area of the parasitic element; a first antenna and a second antenna that are in the two-antenna array element are bent slot slot antennas symmetrical to each other with respect to a central axis between the first antenna and the second antenna; the first antenna is formed by connecting three sections.

14 Claims, 5 Drawing Sheets

(51) Int. Cl.
*H01Q 13/10* (2006.01)
*H01Q 1/24* (2006.01)

(56) References Cited

U.S. PATENT DOCUMENTS

| | | | | |
|---|---|---|---|---|
| 4,812,853 | A | 3/1989 | Negev | |
| 6,130,648 | A | 10/2000 | Rulf et al. | |
| 7,920,099 | B2 | 4/2011 | Chiu et al. | |
| 8,441,408 | B2 | 5/2013 | Kim et al. | |
| 2004/0239567 | A1 | 12/2004 | Van | |
| 2006/0033666 | A1* | 2/2006 | Su | H01Q 9/0414 343/700 MS |
| 2006/0132373 | A1 | 6/2006 | Yuanzhu | |
| 2012/0214424 | A1* | 8/2012 | Yeh | H01Q 1/2275 455/73 |
| 2013/0169496 | A1* | 7/2013 | Miyoshi | H01Q 13/16 343/767 |
| 2015/0229026 | A1* | 8/2015 | Lindmark | H01Q 21/064 343/770 |

FOREIGN PATENT DOCUMENTS

| | | | |
|---|---|---|---|
| CN | 101859928 | A | 10/2010 |
| CN | 202839949 | U | 3/2013 |
| CN | 103187617 | A | 7/2013 |
| EP | 1791214 | A1 | 5/2007 |

OTHER PUBLICATIONS

Chiu et al., "24-Port and 36-Port Antenna Cubes Suitable for MIMO Wireless Communications," IEEE Transactions on Antennas and Propagation, vol. 56, No. 4, pp. 1170-1176, Institute of Electrical and Electronics Engineers, New York, New York (Apr. 2008).

Chiu et al., "Reduction of Mutual Coupling Between Closely-Packed Antenna Elements," IEEE Transactions on Antennas and Propagation, vol. 55, No. 6, pp. 1732-1738, Institute of Electrical and Electronics Engineers, New York, New York (Jun. 2007).

Diallo et al., "Study and reduction of the Mutual Coupling Between Two Mobile Phone PIFAs Operating in the DCS1800 and UMTS Bands," IEEE Transactions on Antennas and Propagation, vol. 54, No. 11, pp. 3063-3074, Institute of Electrical and Electronics Engineers, New York, New York (Nov. 2006).

Getu et al., "The Effect of Mutual Coupling on the Capacity of the MIMO Cube," IEEE Antennas and Wireless Propagation Letters, vol. 4, pp. 240-244, Institute of Electrical and Electronics Engineers, New York, New York (2005).

Chen et al., "Broadband High-Gain Microstrip Array Antennas for WIMAX Base Station," IEEE Transactions on Antennas and Propagation, vol. 60, No. 8, pp. 3977-3980, Institute of Electrical and Electronics Engineers, New York, New York (Aug. 2012).

* cited by examiner

ANTENNA APPARATUS

CROSS-REFERENCE TO RELATED APPLICATIONS

This application is a continuation of International Application No. PCT/CN2014/073820, filed on Mar. 21, 2014, which is hereby incorporated by reference in its entirety.

TECHNICAL FIELD

Embodiments of the present invention relate to the communications field, and more specifically, to an antenna apparatus.

BACKGROUND

There are two design trends in a multiple-input and multiple-output (MIMO) technology: implementing multiband working of an antenna and reducing couplings between multiple antennas. In a MIMO technology, a groove is etched on an antenna radiation branch to reduce couplings between antennas. Such an antenna has a simple structure and is relatively easy to implement; however, generally, impedance bandwidth is relatively narrow, and antenna radiation efficiency is relatively low. In another MIMO technology, feeds in multiple forms are introduced to one antenna, so that different patterns or polarization modes are implemented to reduce couplings between antennas. However, this structure features a relatively large size, and is suitable only for a relatively large terminal in a mobile device.

SUMMARY

Embodiments of the present invention provide an antenna apparatus, so that more antennas can be arranged in a relatively small area at relatively low costs, which increases a system capacity of an antenna system.

According to a first aspect, an antenna apparatus is provided. The apparatus includes multiple antenna elements, where the antenna element includes a dielectric plate, one two-antenna array element, and one parasitic element; the two-antenna array element is located at the front of the dielectric plate; the parasitic element is located on the back of the dielectric plate, and a location of the two-antenna array element falls within an area of the parasitic element; a first antenna and a second antenna that are in the two-antenna array element are bent slot slot antennas symmetrical to each other with respect to a central axis (L) between the first antenna and the second antenna; the first antenna is formed by connecting three sections, that is, a section A, a section B, and a section C; and both the section A and the section C are perpendicular to the section B and located on a same side of the section B, both the section A and the section C are parallel to the central axis, a first endpoint (A1) of the section A is connected to a first endpoint (B1) of the section B, and a first endpoint (C1) of the section C is connected to a second endpoint (B2) of the section B.

With reference to the first aspect, in a first possible implementation manner, specific implementation is: a value range of a length (t1) of a longer section in the section A and the section C in the first antenna is 20.6-22.8 mm, a value range of a length (t3) of a shorter section in the section A and the section C in the first antenna is 12.3-13.7 mm, a value range of a length (t2) of the section B in the first antenna is 7.9-8.7 mm, a value range of a shortest distance (d1) between two adjacent sections in the first antenna and the second antenna is 7.6-8.4 mm, and a value range of an antenna width (d2) of each of the first antenna and the second antenna is 1.5-1.7 mm.

With reference to the first aspect or the first possible implementation manner of the first aspect, in a second possible implementation manner, specific implementation is: the value range of the length (t1) of the longer section in the section A and the section C in the first antenna is 21.7 mm, a value of the length (t3) of the shorter section in the section A and the section C in the first antenna is 13 mm, a value of the length (t2) of the section B in the first antenna is 8.3 mm, a value of the shortest distance (d1) between the two adjacent sections in the first antenna and the second antenna is 8 mm, and a value of the antenna width (d2) of each of the first antenna and the second antenna is 1.6 mm.

With reference to the first aspect or the first possible implementation manner of the first aspect or the second possible implementation manner of the first aspect, in a third possible implementation manner, specific implementation is: both the first antenna and the second antenna are in a half-wavelength slot antenna structure.

With reference to the first aspect or any possible implementation manner in the first possible implementation manner of the first aspect to the third possible implementation manner of the first aspect, in a fourth possible implementation manner, specific implementation is: a feed point (Q1) of the first antenna is located at the longer section in the section A and the section C in the first antenna, and is close to a second endpoint (A2) of the longer section in the section A and the section C in the first antenna, and a feed point (Q2) of the second antenna is symmetrical to the feed point (Q1) of the first antenna with respect to the central axis (L).

With reference to the fourth possible implementation manner of the first aspect, in a fifth possible implementation manner, specific implementation is: a value range of a distance (t4) between the second endpoint (A2) of the longer section in the section A and the section C in the first antenna and the feed point (Q1) is 2.8-3.2 mm.

With reference to the fifth possible implementation manner of the first aspect, in a sixth possible implementation manner, specific implementation is: a value of the distance (t4) between the second endpoint of the longer section in the section A and the section C in the first antenna and the feed point is 3 mm.

With reference to the first aspect or any possible implementation manner in the first possible implementation manner of the first aspect to the sixth possible implementation manner of the first aspect, in a seventh possible implementation manner, specific implementation is: a shape of the parasitic element is a rectangle.

With reference to the seventh possible implementation manner of the first aspect, in an eighth possible implementation manner, specific implementation is: a value range of a length (w1) of a rectangular outer side that is of the parasitic element and parallel to the central axis (L) is 26-28.8 mm, a value range of a length (p1) of a rectangular outer side that is of the parasitic element and perpendicular to the central axis (L) is 30.4-33.6 mm, and a value range of an element width (d3) of the parasitic element is 0.9-1.1 mm.

With reference to the eighth possible implementation manner of the first aspect, in a ninth possible implementation manner, specific implementation is: a value of the length (w1) of the rectangular outer side that is of the parasitic element and parallel to the central axis (L) is 27.4 mm, a value of the length (p1) of the rectangular outer side that is of the parasitic element and perpendicular to the central axis (L) is 32 mm, and a value of the element width (d3) of the parasitic element is 1 mm.

With reference to the first aspect or any possible implementation manner in the first possible implementation manner of the first aspect to the ninth possible implementation manner of the first aspect, in a tenth possible implementation manner, specific implementation is: the dielectric plate is FR4, and a value range of a thickness of the dielectric plate is 1.5-1.7 mm.

With reference to the tenth possible implementation manner of the first aspect, in an eleventh possible implementation manner, specific implementation is: a value of the thickness of the dielectric plate is 1.6 mm.

With reference to the eleventh possible implementation manner of the first aspect, in a twelfth possible implementation manner, specific implementation is: a dielectric constant of the dielectric plate is 4.4.

With reference to the first aspect or any possible implementation manner in the first possible implementation manner of the first aspect to the twelfth possible implementation manner of the first aspect, in a thirteenth possible implementation manner, specific implementation is: in an area of 135 mm*200 mm, the antenna apparatus includes 4*5 antenna elements, where four rows of the antenna elements are included in a direction corresponding to a side of 135 mm of the antenna apparatus, five columns of the antenna elements are included in a direction corresponding to a side of 200 mm of the antenna apparatus, and a central axis of a two-antenna array element in each antenna element in the 4*5 antenna elements is parallel to the side of 135 mm of the antenna apparatus.

With reference to the first aspect or any possible implementation manner in the first possible implementation manner of the first aspect to the twelfth possible implementation manner of the first aspect, in a fourteenth possible implementation manner, specific implementation is: in an area of 85 mm*150 mm, the antenna apparatus includes 2*5 antenna elements, where two rows of antenna elements are included in a direction corresponding to a side of 85 mm of the antenna apparatus, five columns of the antenna elements are included in a direction corresponding to a side of 150 mm of the antenna apparatus, and a central axis of a two-antenna array element in each antenna element in the 2*5 antenna elements is parallel to the side of 150 mm of the antenna apparatus.

Based on the foregoing technical solutions, according to the antenna apparatus in the embodiments of the present invention, multiple antenna array elements at a relatively low self-coupling degree are cascaded in a relatively small area, so that more antennas can be arranged in the relatively small area at relatively low costs, which increases a system capacity of an antenna system.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

An embodiment of the present invention provides a high-density antenna apparatus.

Figure 1:
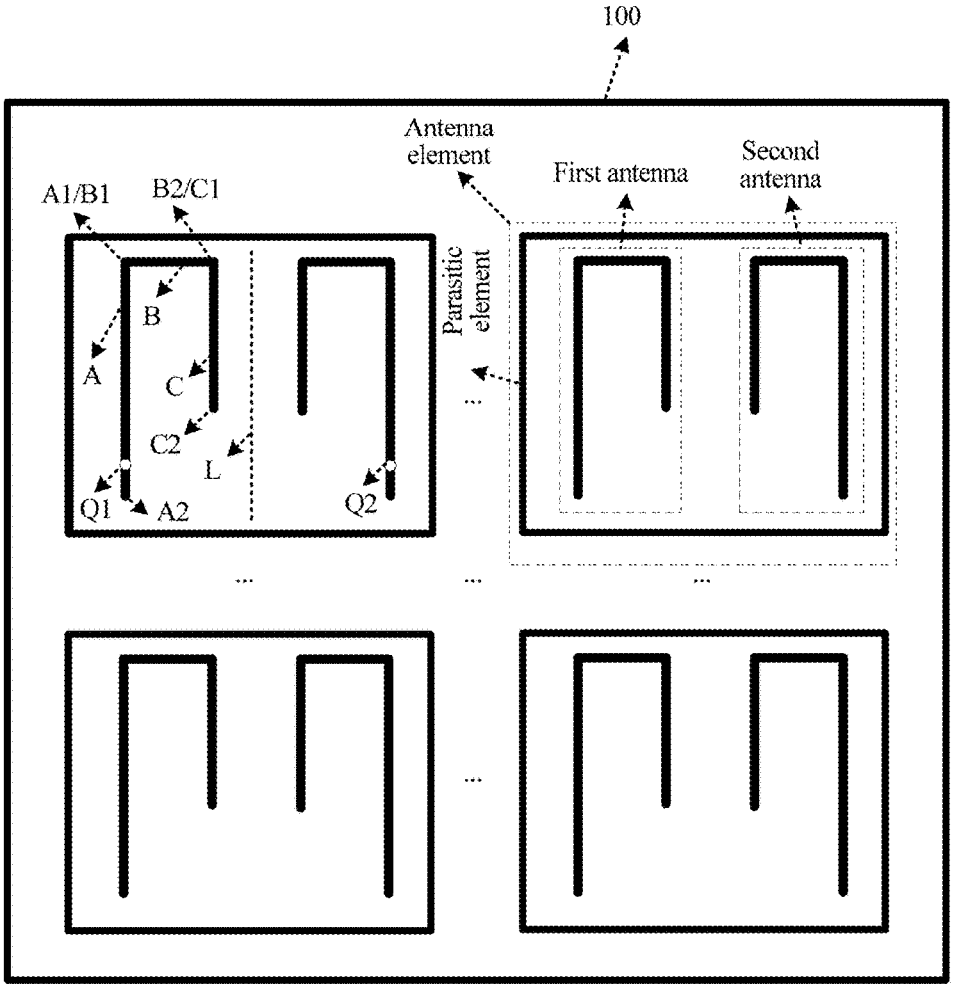
FIG. 1 is a schematic structural diagram of an antenna apparatus according to an embodiment of the present invention.

FIG. 1 is a schematic structural diagram of an antenna apparatus 100 according to an embodiment of the present invention. As shown in FIG. 1, the antenna apparatus may include multiple antenna elements, and the antenna apparatus is formed by cascading the multiple antenna elements. In one antenna element, a dielectric plate, one two-antenna array element, and one parasitic element may be included, where the two-antenna array element is located at the front of the dielectric plate, the parasitic element is located on the back of the dielectric plate, and a location of the two-antenna array element falls within an area of the parasitic element. A first antenna and a second antenna that are in the two-antenna array element are bent slot antennas symmetrical to each other with respect to a central axis between the first antenna and the second antenna, where slot may be referred to as, but is not limited to, slot in English. The first antenna is formed by connecting three sections, that is, a section A, a section B, and a section C, both the section A and the section C are perpendicular to the section B and located on a same side of the section B, both the section A and the section C are parallel to the central axis, a first endpoint (A1) of the section A is connected to a first endpoint (B1) of the section B, and a first endpoint (C1) of the section C is connected to a second endpoint (B2) of the section B.

Figure 2:
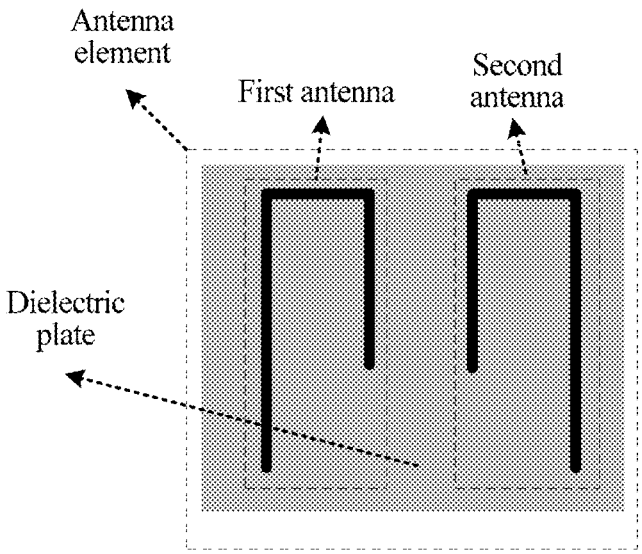
FIG. 2 is a schematic structural diagram of the front of an antenna element according to an embodiment of the present invention.
Figure 3:
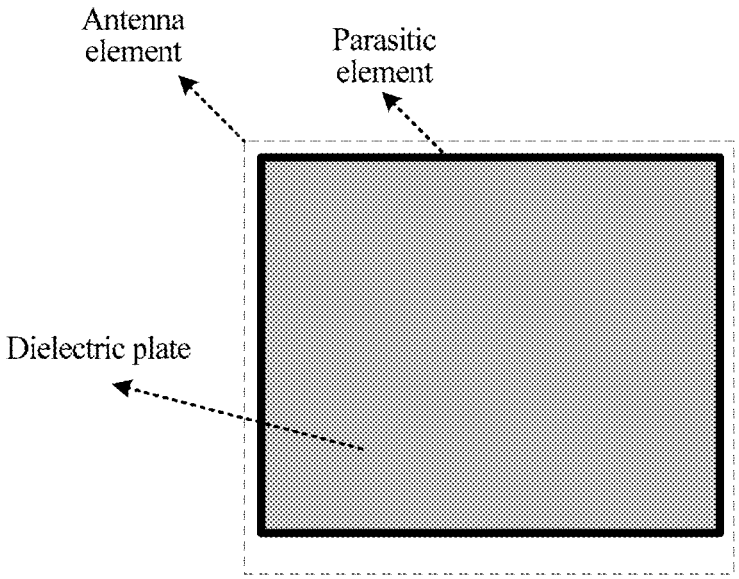
FIG. 3 is a schematic structural diagram of the back of an antenna element according to an embodiment of the present invention.

A specific structure of an antenna element in the antenna apparatus is shown in FIG. 2 and FIG. 3.

FIG. 2 is a schematic structural diagram of the front of an antenna element according to an embodiment of the present invention. A gray part is the dielectric plate, and both the first antenna and the second antenna that are in the two-antenna array element are located at the front of the dielectric plate.

FIG. 3 is a schematic structural diagram of the back of an antenna element according to an embodiment of the present invention. A gray part is the dielectric plate, and the parasitic element is located on the back of the dielectric plate.

It may be learned with reference to FIG. 2 and FIG. 3 that the location of the two-antenna array element falls within the area of the parasitic element. In addition, sizes of the dielectric plate and the parasitic element in the antenna element shown in FIG. 3 are the same; however, actually, because the parasitic element needs to be parasitized on the dielectric plate, a length and a width of the dielectric plate are generally larger than those of the parasitic element, and an area of the parasitic element falls within a range of the dielectric plate.

In addition, it should be understood that, that the first antenna and the second antenna are symmetrical to each other with respect to the central axis means that all components, including antenna shapes, antenna widths, feed points, and the like, of the two antennas are symmetrical.

In addition, a bent slot antenna structure shown in FIG. 1 is used for the first antenna and the second antenna that are in the antenna array element, so that a mutual coupling degree between antennas is relatively low, and an overall area of the antenna array element is relatively small. In addition, the first antenna and the second antenna are symmetrical to each other with respect to the central axis, which can also reduce an overall mutual coupling degree of the antenna array element.

By means of design of a parasitic element that surrounds an antenna array element, signal interference between two adjacent antenna array elements can be reduced.

It should be understood that all antenna elements in an antenna apparatus are decoupled, that is, several antenna elements may be added to or deleted from the antenna apparatus according to an antenna requirement.

It should be understood that the antenna apparatus in FIG. 1 shows a manner of arranging antenna elements in multiple rows and multiple columns (M*N); however, an antenna apparatus may be arranged in a form of one row and multiple columns (M*1) or one column and multiple rows (1*N) according to a requirement in an actual case (such as a limitation of a shape).

Figure 4:
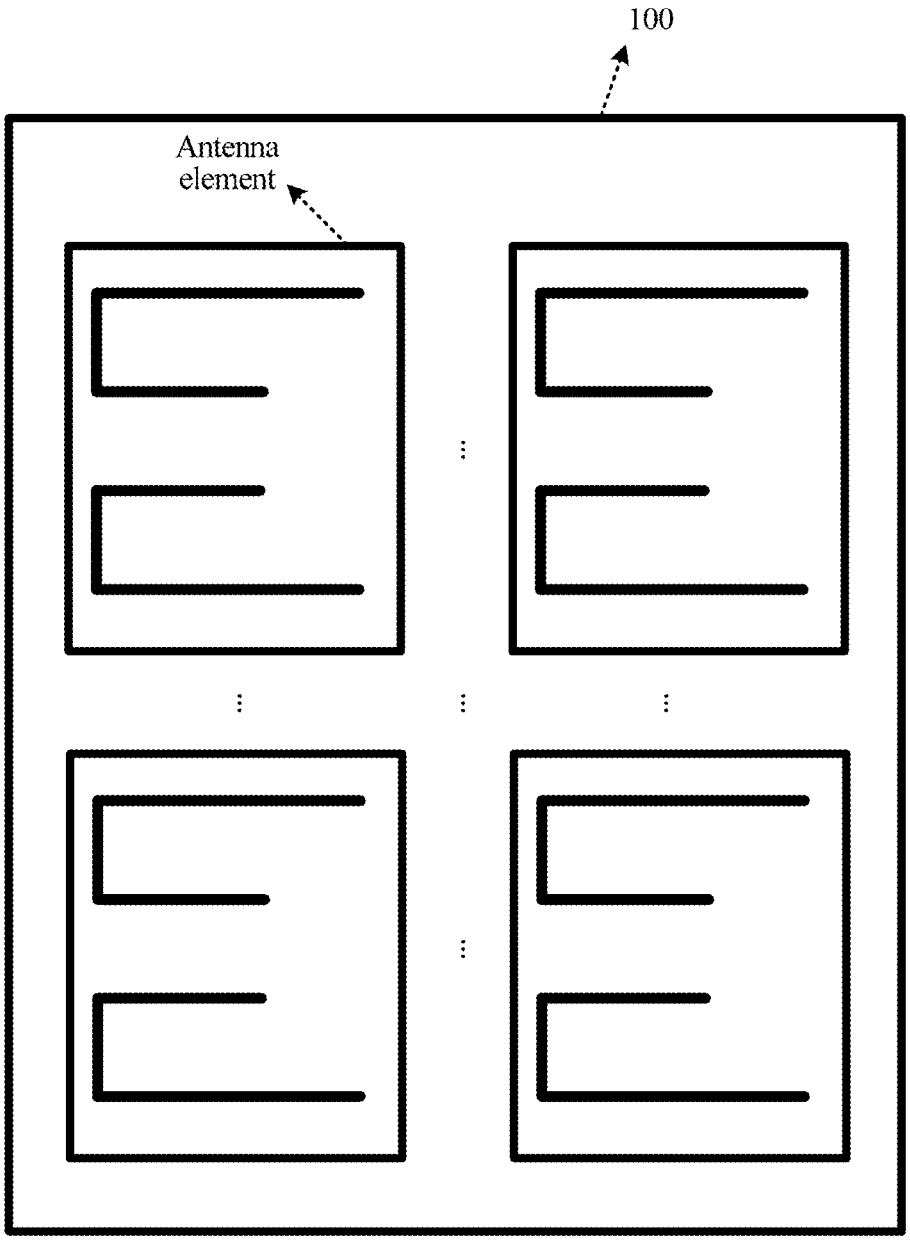
FIG. 4 is another schematic structural diagram of an antenna apparatus according to an embodiment of the present invention.
Figure 5:
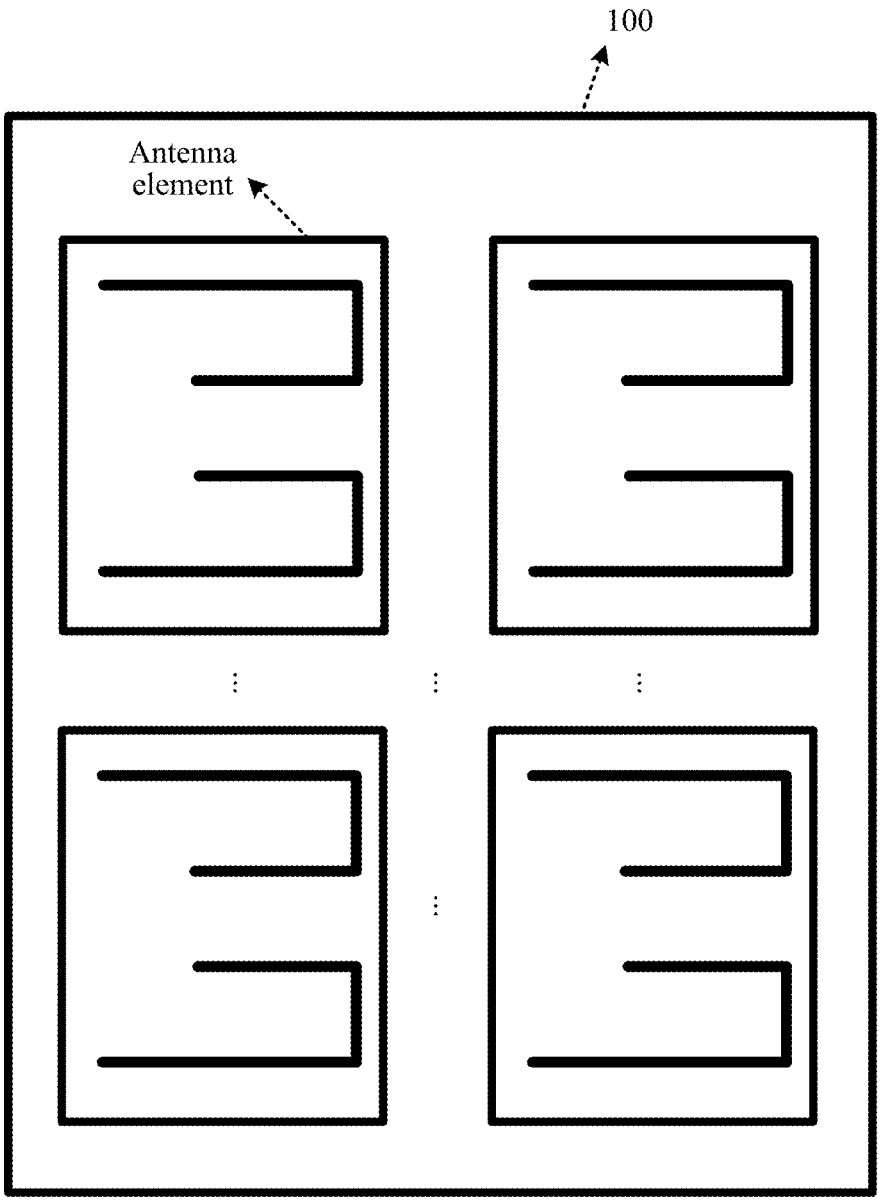
FIG. 5 is still another schematic structural diagram of an antenna apparatus according to an embodiment of the present invention.

It should be understood that an antenna element in the antenna apparatus in FIG. 1 may be placed by means of rotation by a specific angle, such as rotation by ±90° or 180°. Specifically, an antenna arrangement manner shown in FIG. 4 may be obtained by means of rotation by −90°, and an antenna arrangement manner shown in FIG. 5 may be obtained by means of rotation by 180°.

It should be understood that being perpendicular mentioned in this embodiment of the present invention should be understood as being approximately perpendicular. Two lines between which an included angle is between 87° and 93° (90°±3°), such as 88°, 89°, 89.5°, 90°, 90.5°, 91°, or 91.5°, may be considered as being perpendicular. Similarly, being parallel mentioned in this embodiment of the present invention should be understood as being approximately parallel. Two lines between which an included angle is between −3° and 3° (0°±3°), such as −2°, −1°, −0.5°, 0°, 0.5°, 1°, or 1.5°, may be considered as being parallel.

In this embodiment of the present invention, multiple antenna elements are cascaded to form an antenna apparatus; therefore, when requirements on basic counters such as a backhaul loss and antenna isolation are ensured, a coupling degree of the antenna apparatus can be reduced, and more antennas can be arranged in a relatively small area, so that it is possible that large-scale antennas are applied to mobile terminals.

Figure 6:
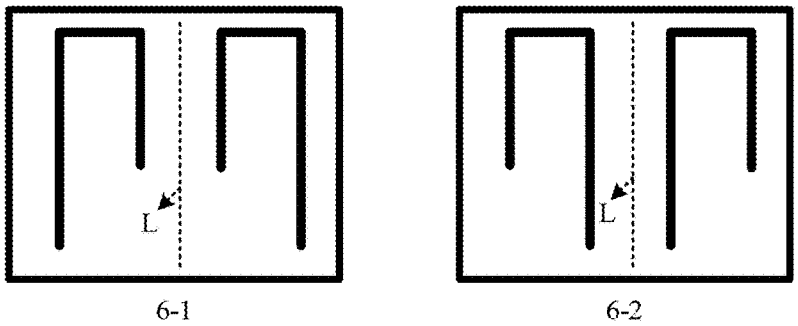
FIG. 6 is a schematic structural diagram of an antenna element according to an embodiment of the present invention.

FIG. 6 is a schematic structural diagram of an antenna element according to an embodiment of the present invention. In a specific application, the antenna element may be arranged in two manners, as shown in 6-1 and 6-2 in FIG. 6. Both an antenna element shown in 6-1 in FIG. 6 and an antenna element shown in 6-2 in FIG. 6 are symmetrical with respect to a y-axis. The antenna element shown in 6-1 in FIG. 6 or 6-2 in FIG. 6 may be rotated by a specific angle to obtain a new antenna structure; however, in essence, the new antenna structure is the same as an antenna structure of the antenna element shown in 6-1 in FIG. 1 or 6-2 in FIG. 6. In this embodiment of the present invention, a structure in 6-1 in FIG. 6 is used as an example to describe the antenna element and the antenna apparatus in this embodiment of the present invention.

Figure 7:
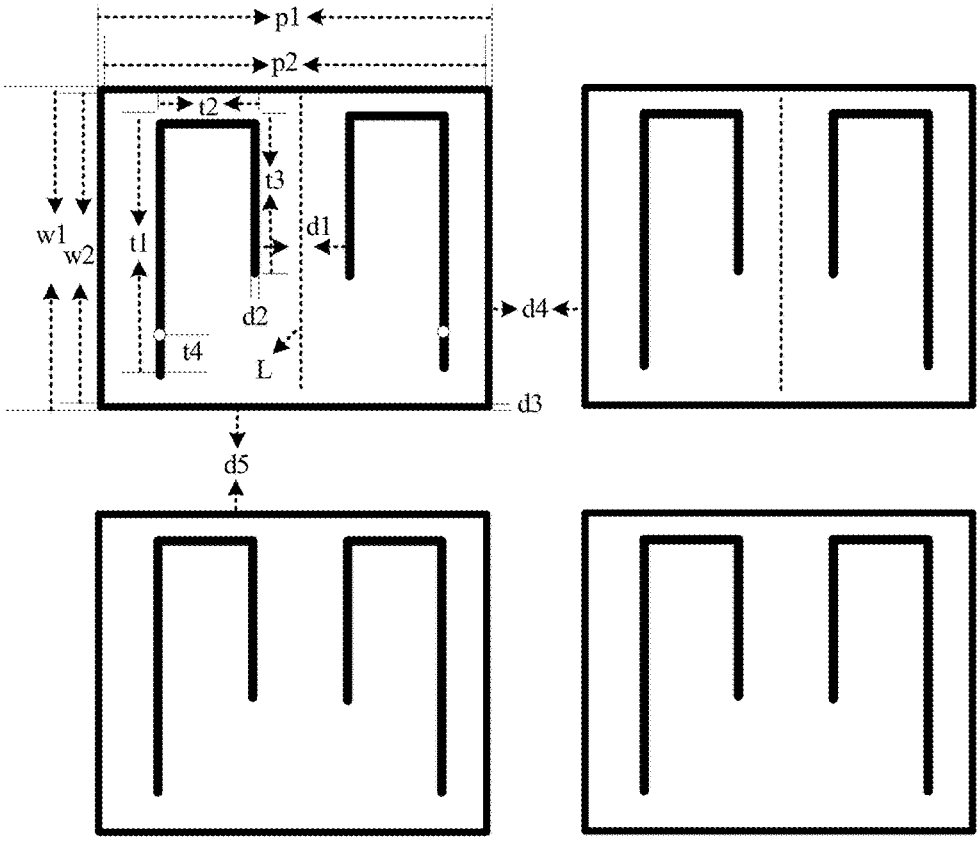
FIG. 7 is a length marking diagram of an antenna apparatus according to an embodiment of the present invention.

FIG. 7 is a length marking diagram of an antenna apparatus according to an embodiment of the present invention. As shown in FIG. 7, in the two-antenna array element in the antenna element, a length of a longer section in the section A and the section C in the first antenna is denoted as t1, a length of the section B is denoted as t2, a length of a shorter section in the section A and the section C in the first antenna is denoted as t3, a feed point of the first antenna is located at the longer section in the section A and the section C in the first antenna, a distance between the feed point of the first antenna and a second endpoint of the section is denoted as t4, an antenna width of the first antenna is denoted as d2, and a distance between the first antenna and the second antenna is denoted as d1.

Optionally, in the two-antenna array element in the antenna element, a value range of t1 is 20.6-22.8 mm, a value range of t2 is 7.9-8.7 mm, a value range of t3 is 12.3-13.7 mm, a value range of d1 is 7.6-8.4 mm, and a value range of d2 is 1.5-1.7 mm. The second antenna is symmetrical to the first antenna, and a length value of the second antenna is the same as a value of a corresponding position of the first antenna. In this case, a mutual coupling degree of the antenna array element is relatively low, and an area occupied by the antenna array element is also relatively small; therefore, a mutual coupling degree of the antenna element or the final antenna apparatus is low, and an area occupied by the antenna element or the antenna apparatus is small.

Preferably, a value of t1 is 21.7 mm, a value of t2 is 8.3 mm, a value of t3 is 13 mm, a value of d1 is 8 mm, and a value of d2 is 1.6 mm. In this case, better emulation effects can be achieved for the mutual coupling degree and the area that are of the antenna array element. In addition, in an actual application, this group of lengths may further fluctuate within a specific range, such as ±0.5%, ±1%, ±1.5%, ±2%, ±2.5%, ±3%, or ±3.5%.

Optionally, in the two-antenna array element in the antenna element, both the first antenna and the second antenna are in a half-wavelength slot antenna structure. By using the half-wavelength slot antenna structure, the antenna array element can achieve better transmission performance of an antenna, so that the antenna element or the final antenna apparatus can achieve better antenna transmission performance.

Optionally, the feed point of the first antenna may be located at any section in the first antenna. Preferably, the feed point (Q1 in FIG. 1) of the first antenna is located at the longer section (the section A in FIG. 1) in the section A and the section C, and is close to the second endpoint (an endpoint not connected to the section B, that is, A2 in FIG. 1) of the section, and a feed point (Q2 in FIG. 1) of the second antenna is symmetrical to the feed point (Q1 in FIG. 1) of the first antenna with respect to the central axis L. A value range of the distance t4 between the feed point of the first antenna and the second endpoint (A2 in FIG. 1) of the section A is 2.8-3.2 mm. Preferably, a value of t4 may be 2.9 mm, 3 mm, or 3.1 mm.

In addition, on the back of the dielectric plate, the location of the two-antenna array element is encircled by using the parasitic element, which can increase isolation between antenna elements. Optionally, the parasitic element may be in multiple shapes, such as a circle, a rectangle, and a regular hexagon. A circle, a regular hexagon, or another shape may be used. As shown in FIG. 7, when the parasitic element is a rectangle, a length of a rectangular outer side that is of the parasitic element and parallel to the central axis L is denoted as w1, a length of a rectangular inner side that is of the parasitic element and parallel to the central axis L is denoted as w2, a length of a rectangular outer side that is of the parasitic element and perpendicular to the central axis L is denoted as p1, a length of a rectangular inner side that is of the parasitic element and perpendicular to the central axis L is denoted as p2, and an element width of the parasitic element is denoted as d3, where w1=w2+2*d3, and p1=p2+2*d3.

Optionally, in an embodiment, when the parasitic element is a rectangle, a value range of w1 is 26-28.8 mm, a value range of p1 is 30.4-33.6 mm, and a value range of d3 is 0.9-1.1 mm. Preferably, a value of w1 is 27.4 mm, the value range of p1 is 32 mm, and the value range of d3 is 1 mm.

In addition, multiple materials may be used for the dielectric plate. For example, the dielectric plate in the antenna element may be FR4, and a value range of a thickness of the dielectric plate is 1.5-1.7 mm. Preferably, a value of the thickness of the dielectric plate is 1.6 mm, and a dielectric constant of the dielectric plate is 4.4.

In addition, in a process of cascading antenna elements, a specific distance should be kept between any two antenna elements. As shown in FIG. 7, in two adjacent antenna elements, a distance between sides that are of parasitic elements and parallel to central axes (L) of two-antenna array elements may be denoted as d4, and a distance between sides that are of parasitic elements and perpendicular to central axes (L) of two-antenna array elements may be denoted as d5. Values of d4 and d5 may be determined according to an actual area of the antenna apparatus.

The antenna apparatus in this embodiment of the present invention is obtained by cascading of multiple antenna elements. An example of an antenna element that is 32 mm in length and 27.4 mm in width (a peripheral length and a peripheral width of a parasitic element) is used to describe several layouts of the antenna apparatus.

In an area of an iPad Mini size (that is, 200 mm*135 mm), the antenna apparatus in an embodiment of the present invention may include 4*5 antenna elements, where four rows of the antenna elements are included in a direction corresponding to a side of 135 mm of the antenna apparatus, five columns of the antenna elements are included in a direction corresponding to a side of 200 mm of the antenna apparatus, and a central axis of a two-antenna array element in each antenna element in the 4*5 antenna elements is parallel to the side of 135 mm of the antenna apparatus. That is, for the antenna apparatus in an embodiment of the present invention, 5*4*2=40 antennas may be arranged in an area of 200 mm*135 mm. In this case, a maximum value of d4 is (200−32*5)/(5−1)=10 mm, and a maximum value of d5 is (135−27.4*4)/(4−1)=8.4 mm. If it is considered that specific space should also be reserved for an edge of the antenna apparatus, the maximum value of d4 is (200−32*5)/5=8 mm, and the maximum value of d5 is (135−27.4*4)/4=6.3 mm.

In an experimental environment, it is learned by means of measurement that a capacity of a 40*40 MIMO system in this antenna design increases by six times relative to a capacity of a conventional 4*4 MIMO system.

In an area of a Samsung Note size (that is, 150 mm*85 mm), the antenna apparatus in an embodiment of the present invention may include 2*5 antenna elements, where two rows of the antenna elements are included in a direction corresponding to a side of 85 mm of the antenna apparatus, five columns of the antenna elements are included in a direction corresponding to a side of 150 mm of the antenna apparatus, and a central axis of a two-antenna array element in each antenna element in the 2*5 antenna elements is parallel to the side of 150 mm of the antenna apparatus. That is, for the antenna apparatus in an embodiment of the present invention, 5*2*2=20 antennas may be arranged in an area of 150 mm*85 mm. In this case, a maximum value of d4 is (85−32*2)/(2−1)=21 mm, and a maximum value of d5 is (150−27.4*5)/(5−1)=3.2 mm. If it is considered that specific space should also be reserved for an edge of the antenna apparatus, the maximum value of d4 is (85−32*2)/2=10.5 mm, and the maximum value of d5 is (150−27.4*5)/5=2.6 mm.

In an experimental environment, it is learned by means of measurement that a capacity of a 20*20 MIMO system in this antenna design increases by three times relative to a capacity of a conventional 4*4 MIMO system.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiments are merely exemplary. For example, the unit division is merely logical function division and may be other divisions in actual implementation. For example, multiple units or components may be combined or integrated into another system, or some features may be ignored or not performed. In addition, the displayed or discussed mutual couplings or direct couplings or communication connections may be implemented by using a number of interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on multiple network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present invention essentially, or the part contributed by the prior art, or some of the technical solutions may be implemented in a form of a software product. The computer software product may be stored in a storage medium, and may include several instructions for instructing a computer device (which may be a personal computer, a server, or a network device) to perform all or some of the steps of the methods described in the embodiments of the present invention. The foregoing storage medium may be any medium that can store program code, such as a Universal Serial Bus (USB) flash drive, a removable hard disk, a read-only memory (ROM), a random access memory (RAM), a magnetic disk, or an optical disc.

The foregoing descriptions are merely specific implementation manners of embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An antenna apparatus comprising: multiple antenna elements, each multiple antenna element comprising: a dielectric plate, a two-antenna array element comprising a first antenna and a second antenna, and a parasitic element, wherein the two-antenna array element is located on a front of the dielectric plate;

the parasitic element is located on a back of the dielectric plate;

a location of the two-antenna array element falls within an area of the parasitic element;

the first antenna and the second antenna of the two-antenna array element are bent-slot slot antennae;

the first antenna and the second antenna of the two-antenna array element are symmetrical to each other with respect to a central axis between the first antenna and the second antenna; and the first antenna comprises a first section, a second section, and a third section, wherein the first section is longer in length than the third section, both the first section and the third section are perpendicular to the second section, both the first section and the third section are located on a same side of the second section, both the first section and the third section are parallel to the central axis, a first endpoint of the first section is connected to a first endpoint of the second section, and a first endpoint of the third section is connected to a second endpoint of the second section;

wherein a length of the first section of the first antenna is in a range of 20.6-22.8 mm, a length of the third section of the first antenna is in a range of 12.3-13.7 mm, a length of the second section of the first antenna is in a range of 7.9-8.7 mm, a shortest distance between two adjacent sections of the first antenna and the second antenna is in a range of 7.6-8.4 mm, and an antenna width of each of the sections of the first antenna and the second antenna is in a range of 1.5-1.7 mm.

2. The antenna apparatus according to claim 1, wherein the length of the first section of the first antenna is 21.7 mm, the length of the third section of the first antenna is 13 mm, the length of the second section of the first antenna is 8.3 mm, the shortest distance between the two adjacent sections of the first antenna and the second antenna is 8 mm, and the antenna width of each of the sections of the first antenna and the second antenna is 1.6 mm.

3. The antenna apparatus according to claim 1, wherein both the first antenna and the second antenna are in a half-wavelength slot antenna structure.

4. The antenna apparatus according to claim 1, wherein a feed point of the first antenna is on the first section of the first antenna, and is closer to the second endpoint than to the first endpoint of the first section of the first antenna; and a feed point of the second antenna is symmetrical to the feed point of the first antenna with respect to the central axis.

5. The antenna apparatus according to claim 4, wherein a distance between the second endpoint of the first section of the first antenna and the feed point of the first antenna is in a range of 2.8-3.2 mm.

6. The antenna apparatus according to claim 5, wherein the distance between the second endpoint of the first section of the first antenna and the feed point of the first antenna is 3 mm.

7. The antenna apparatus according to claim 1, wherein a shape of the parasitic element is a rectangle.

8. The antenna apparatus according to claim 7, wherein a length of a rectangular outer side of the parasitic element that is parallel to the central axis is in a range of 26-28.8 mm, a length of a rectangular outer side of the parasitic element that is perpendicular to the central axis is in a range of 30.4-33.6 mm, and an element width of the parasitic element is in a range of 0.9-1.1 mm.

9. The antenna apparatus according to claim 8, wherein the length of the rectangular outer side of the parasitic element that is parallel to the central axis is 27.4 mm, the length of the rectangular outer side of the parasitic element that is perpendicular to the central axis is 32 mm, and the element width of the parasitic element is 1 mm.

10. The antenna apparatus according to claim 1, wherein the dielectric plate is FR4, and a thickness of the dielectric plate is in a range of 1.5-1.7 mm.

11. The antenna apparatus according to claim 10, wherein the thickness of the dielectric plate is 1.6 mm.

12. The antenna apparatus according to claim 10, wherein a dielectric constant of the dielectric plate is 4.4.

13. The antenna apparatus according to claim 1, wherein the antenna apparatus comprises twenty antenna elements, the antenna elements are arranged in a four by five configuration in a 135 mm by 200 mm area, and the central axis of the two-antenna array element of each antenna element is parallel to the 135 mm side of the antenna apparatus.

14. The antenna apparatus according to claim 1, wherein the antenna apparatus comprises ten antenna elements, the antenna elements are arranged in a two by five configuration in an 85 mm by 150 mm area, and the central axis of the two-antenna array element in each antenna element is parallel to the 150 mm side of the antenna apparatus.

* * * * *